US006523326B1

(12) United States Patent
Sting et al.

(10) Patent No.: US 6,523,326 B1
(45) Date of Patent: Feb. 25, 2003

(54) DEVICE FOR HANDLING OBJECTS IN SHEET FORM

(75) Inventors: Martin Sting, Bad Vilbel (DE); Christian Botschek, Rodermark (DE)

(73) Assignee: Pitney Bowes Technologies GmbH, Friedberg (DE)

( * ) Notice: Subject to any disclaimer, the term of this patent is extended or adjusted under 35 U.S.C. 154(b) by 0 days.

(21) Appl. No.: 09/700,527

(22) PCT Filed: Mar. 27, 2000

(86) PCT No.: PCT/EP00/02694

§ 371 (c)(1),
(2), (4) Date: Nov. 15, 2000

(87) PCT Pub. No.: WO00/58115

PCT Pub. Date: Oct. 5, 2000

(30) Foreign Application Priority Data

Mar. 25, 1999 (DE) ..... 199 13 635

(51) Int. Cl.[7] ..... B65B 61/20
(52) U.S. Cl. ..... 53/284.3; 53/569; 53/252
(58) Field of Search ..... 53/284.3, 569, 53/460, 252, 381.5

(56) References Cited

U.S. PATENT DOCUMENTS 5,284,004 A * 2/1994 Metzler ..... 53/589
5,848,518 A * 12/1998 Bufalini et al. ..... 53/569
5,992,132 A * 11/1999 Auerbach ..... 53/569
6,289,658 B1 * 9/2001 Sting et al. ..... 53/569

FOREIGN PATENT DOCUMENTS

DE 4116708 11/1992
DE 19500746 7/1996

* cited by examiner

*Primary Examiner*—Eugene Kim
*Assistant Examiner*—Sameh Tawfik
(74) *Attorney, Agent, or Firm*—Michael J. Cummings; Charles R Malandra; Angelo N. Chaclas

(57) ABSTRACT

In an apparatus for handling sheet-like articles, in particular in an envelope-filling station, the smoothness of running is increased, even in the case of high cycle speeds, in that a guide control means is provided so that push-in fingers, which are moved back and forth by an actuating arrangement, can be lowered and raised relative to a base plate both in the operating stroke and in the return stroke, it being the case that provided for the operating stroke is a framework-side guide part and for the return stroke is a diverter-like changeover guide part, which is actuated by the guide contact element itself and ensures in each case smooth transitions to the housing-side guide part.

9 Claims, 4 Drawing Sheets

DEVICE FOR HANDLING OBJECTS IN SHEET FORM

TECHNICAL FIELD

The invention relates to an apparatus for handling sheet-like articles, in particular enclosures in an envelope-filling station of mail-processing machines, having a base plate, over which the sheet-like articles are conveyed in a state in which they rest on the base plate, having an actuating arrangement, which has a carrier hand which, by means of a drive mechanism of the actuating arrangement, can be moved back and forth over the base plate, parallel to the conveying direction, such that at least part of the carrier hand is guided rectilinearly over the base plate, and having push-in fingers, which are articulated on the carrier hand and, in a guide-controlled manner, are lowered onto the base plate in the operating stroke and are raised from the base plate in the return stroke, the push-in fingers being fastened on a push-in-finger shaft which is coupled to a guide contact element.

BACKGROUND ART

Apparatuses of this type are disclosed, for example, in DE 195 00 746 A1. DE 41 16 708 A1 also describes a handling apparatus of the type defined above.

In known envelope-filling stations of this type, in the operating stroke, the position of the push-in fingers is determined by sliding elements at the outer ends of the push-in fingers resting in a sliding manner on the base plate or in grooves of the base plate, while the raised position of the push-in fingers, during the return stroke, is achieved in that a guide strip located beneath the guide contact element is raised for the duration of the return stroke, as a result of which, in the return stroke, the guide contact element is forced onto a route located higher than the base plate and causes the push-in-finger shaft to rotate, which has the effect of raising the push-in fingers. At the end of the return stroke, the guide contact element then drops off from the guide strip, at the rear end of the latter, and the sliding elements at the outer ends of the push-in fingers drop correspondingly onto the base plate or into the guidance grooves of the base plate.

In the case of high operating speeds, a smooth transition of the push-in fingers from the lowered position into the raised position at the end of the operating stroke, and from the raised position into the lowered position at the end of the return stroke, presents difficulties. Since these transition phases have to be carried out in fractions of a second, there may be pronounced noise development. High positive and negative accelerations may result in increased levels of wear, in particular in the region of stops which limit the respective movements. In the known design, the outer ends of the push-in fingers tend to vibrate and move jerkily from time to time.

DISCLOSURE OF THE INVENTION

The object of the invention is to configure an apparatus for handling sheet-like articles of the general type described in the introduction such that, even in the case of high operating speeds, greater smoothness of running of the actuating arrangement and, in particular, smooth and reliable movement of the push-in fingers are achieved without additional complicated control mechanisms having to be provided.

This object is achieved according to the invention by the features specified in claim 1.

An apparatus of the type specified here may be configured, in particular, such that a space above the base plate and beneath the actuating arrangement is kept clear of mechanisms for forward and rearward movement and for upward and downward pivoting of the push-in fingers, such that it is only the push-in fingers, during the operating stroke, which move in this space. This makes it possible for the sheet-like articles which are to be handled to be fed not just transversely with respect to the movement direction of the push-in fingers in the operating stroke and in the return stroke, but also parallel to this movement, that is to say in the direction of the operating stroke. This means that it is possible for an apparatus of the type specified here not just to be attached laterally, as a processing station, to a cyclically actuated conveying path or conveying chain, but also to be placed, as a processing station, over the ends of a conveying path or conveying chain in the manner of a portal, it being possible for said conveying path or conveying chain to be operated cyclically or else continuously.

Advantageous configurations and developments also form the subject matter of the claims following claim 1, and, without the wording thereof being repeated here, you are hereby expressly referred to the contents of these claims.

BRIEF DESCRIPTION OF THE DRAWINGS

A preferred embodiment of an apparatus of the type specified here will now be described with reference to the drawing, in which.

DETAILED DESCRIPTION OF THE INVENTION

Figure 1:
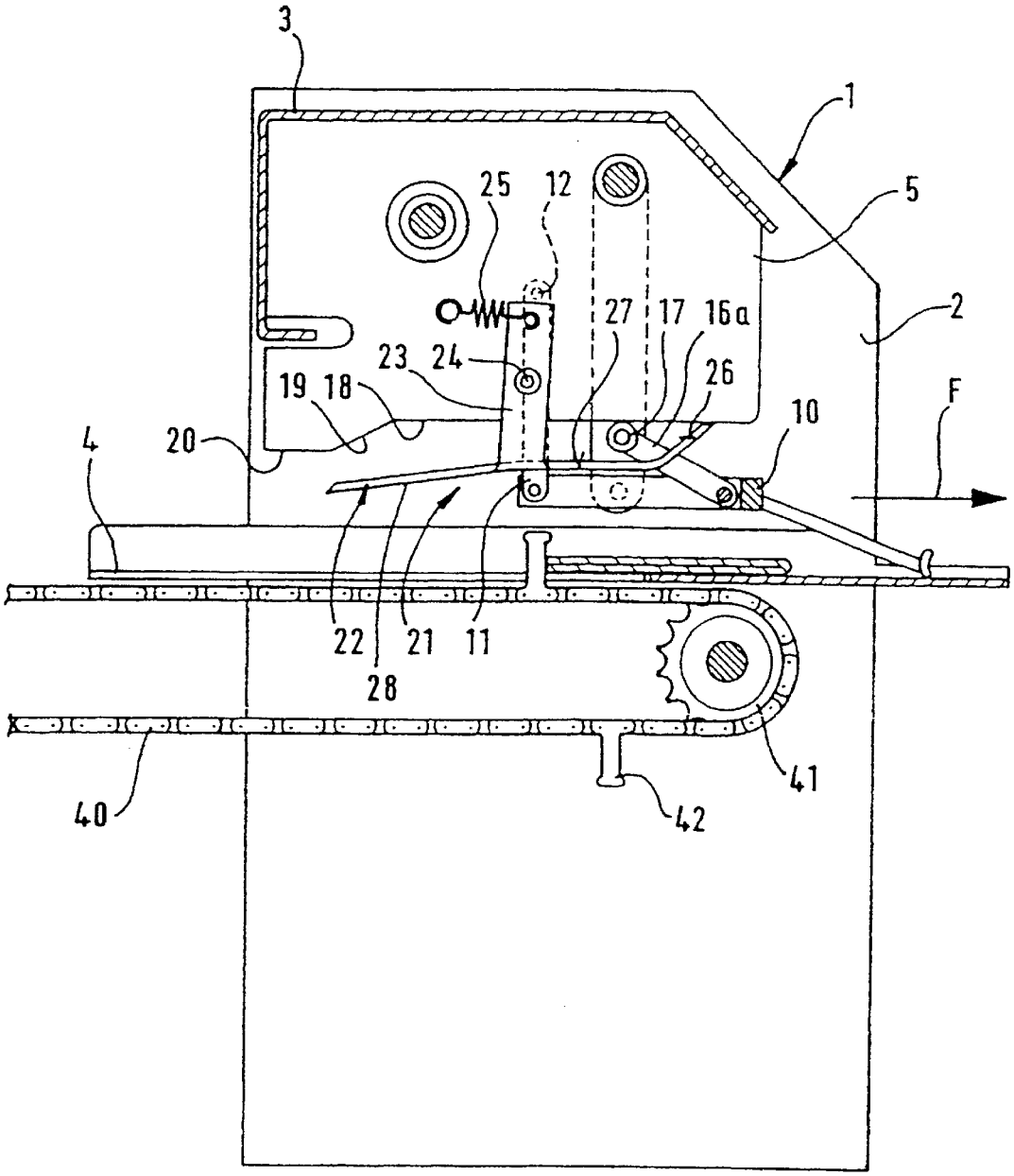
FIG. 1 illustrates a sectional side view of an envelope-filling station in a schematic illustration.

The envelope-filling station which is shown in FIG. 1 contains a housing 1 which is prismatic in side view, transverse with respect to the conveying direction of the envelope-filling station corresponding to the arrow (conveying direction) F, and of which the housing interior is formed between two housing side parts 2 of which one can be seen in FIG. 1, while the other housing part, which is directed toward the person looking at the drawing, is eliminated by the section of the drawing in a vertical section plane. The housing side parts are connected to one another by a housing roof 3, which contains a number of bends, and a base plate 4. Moreover, the housing side parts may be fastened on an elongate machine framework which belongs to a mail-processing machine and passes through between the housing side parts in the conveying direction, although, for the sake of simplicity of the illustration, details in this respect have been left out.

Figure 3:
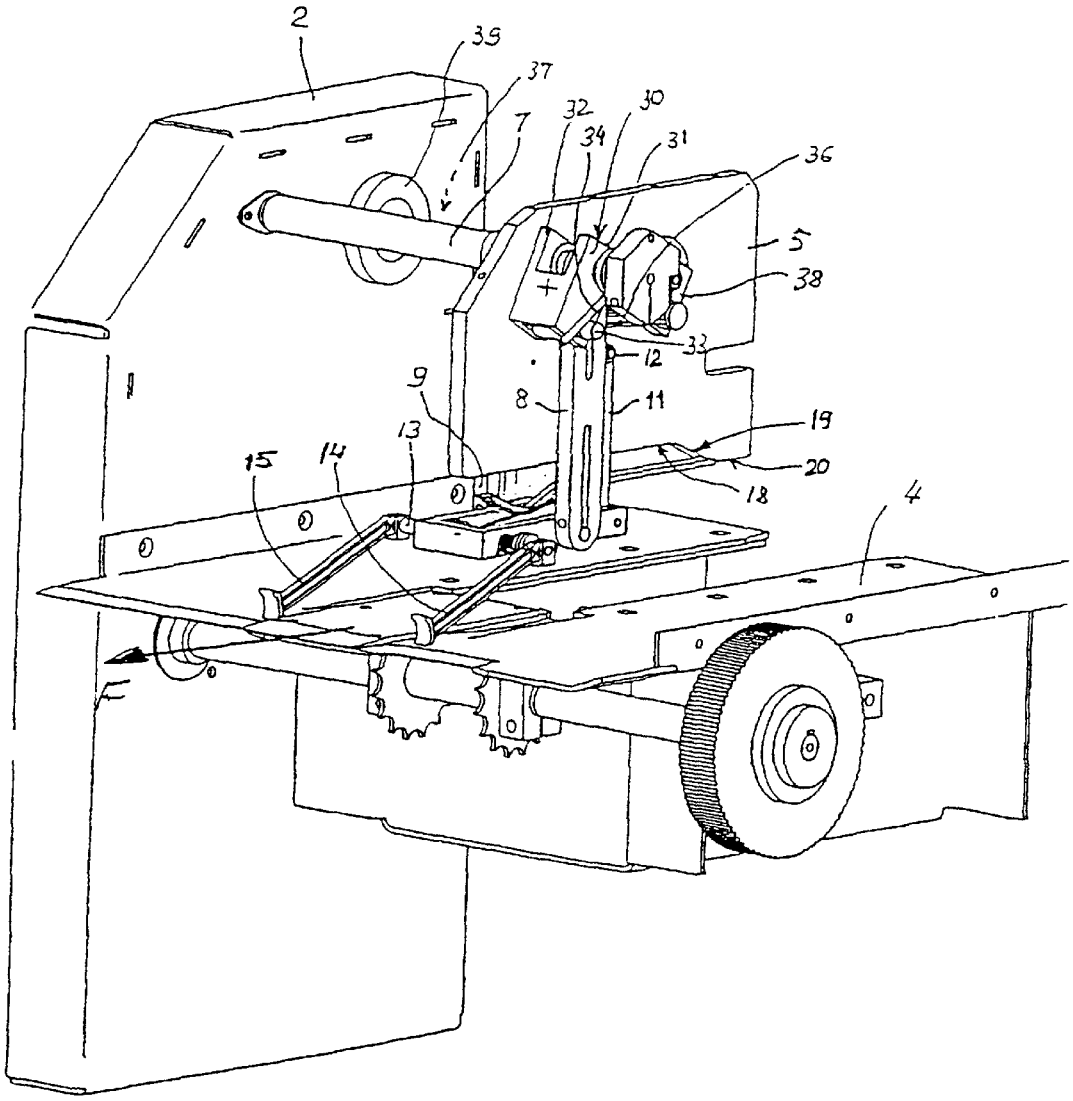
FIG. 3 illustrates a perspective illustration of the apparatus according to FIG. 1 for the purpose of explaining the installation of the actuating arrangement according to FIG. 2 into the housing.

As can be seen from FIG. 3, the housing side parts 2 can be formed by virtue of border flanges of a sheet-metal blank being bent outward in the direction away from the housing interior. Unlike the illustration of FIG. 3, it is also possible for the abutting cut edges of the border flanges to be welded for the purpose of increasing the strength. The same applies for the connecting locations between the housing roof 3 and the housing side parts 2.

Installed beneath the housing roof 3 is a vertical housing intermediate wall 5 which is parallel to the housing side parts 2, is considerably thicker than the housing side parts 2 and may be formed, for example, by an aluminum panel. The top border and a lateral border of the housing intermediate wall 5 are fastened, for example screwed, as can be seen from FIG. 3, flush against the housing roof 3. The bottom border of the housing intermediate wall 5 is at a greater distance from the surface of the base plate 4 and has a stepped formation, the significance of which will be discussed in more detail hereinbelow.

Figure 2:
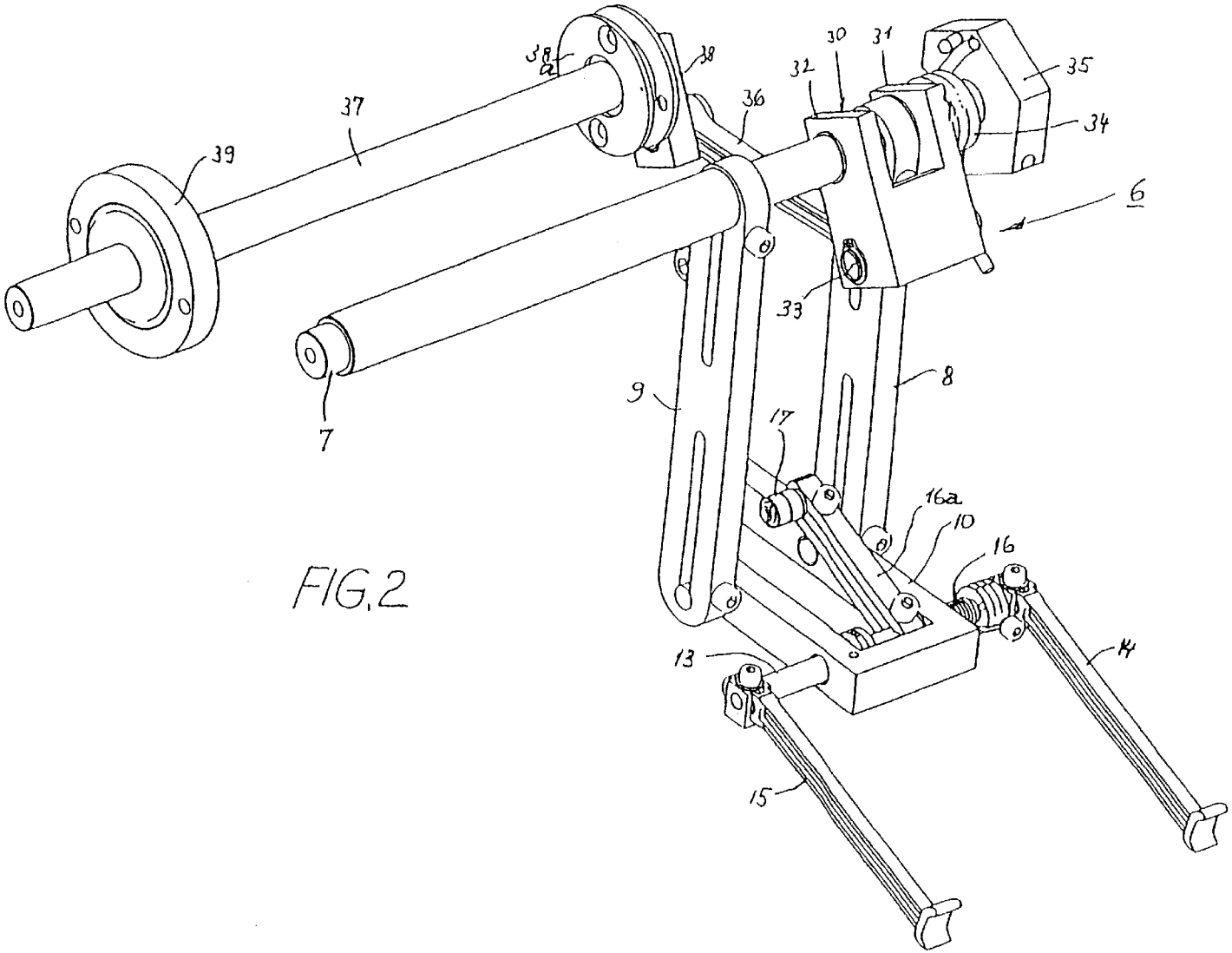
FIG. 2 illustrates a perspective illustration of the actuating arrangement and of the push-in fingers for the apparatus according to FIG. 1.

An actuating arrangement 6, the design of which can clearly be seen in detail from FIG. 2, is installed in the housing 1, formed from the parts 2, 3 and 4. Between one of the housing side parts 2 and the housing intermediate wall 5, a pivot spindle 7 is mounted in the top region of the housing 1. As can be seen from FIG. 3, said pivot spindle passes through the housing intermediate wall 5 but does not extend as far as the other housing side wall 2. Two pivot levers 8 and 9 are fastened on the pivot spindle 7 such that the pivot levers pass downward on both sides of the housing intermediate wall 5. The bottom ends of the pivot levers 8 and 9 are articulated on a carrier hand 10, which is approximately U-shaped in plan view. One U-leg of the U-shaped carrier hand 10 is longer than the other and bears, at its free end, the point of articulation for a link 11, which passes upward, from its point of articulation on the carrier hand 10 to a point of articulation 12 on the housing intermediate wall 5. On the side remote from the point of articulation of the link 11, the carrier hand 10 extends from the points of articulation of the pivot levers 8 and 9 to bearing locations, located in the vicinity of the U-leg, for a push-in-finger shaft 13, on which push-in fingers 14 and 15 are fastened on both sides of the carrier hand 10. It can be seen from FIG. 2 that the push-in-finger shaft 13 projects from the carrier hand 10 on both sides. A helical spring which wraps around the push-in-finger shaft 13 is supported, on the one hand, on the carrier hand 10 and, on the other hand, on an abutment or adjusting ring, seated on the push-in-finger shaft 13, and prestresses the push-in fingers 14 and 15 with respect to the carrier hand 10 with the effect of moving the outer ends of the push-in fingers 14 and 15 downward. It should be noted here that the position of the bearings for the pivot spindle 7 on the housing intermediate wall 5, the position of the point of articulation 12 for the link 11, also the lengths of the pivot levers 8 and 9 of said pivot-lever pair, as well as the length of the link 11 and the relative distances between the points of articulation of the link 11, of the pivot-lever pair 8 and 9 and of the bearing locations for the push-in-finger shaft 13 on the carrier hand 10 are such that a three-member rectilinear-guidance mechanism is produced, this mechanism comprising the link 11, the pivot levers 8 and 9 and the carrier hand 10 and achieving, in a manner known per se, the situation where the push-in-finger shaft 13 is moved back and forth, approximately in a horizontal plane parallel to the base plate 4 at a distance above the latter, in the conveying direction corresponding to the arrow F when the pivot levers 8 and 9 are pivoted back and forth.

It can be seen that on account of the U-shaped configuration of the carrier hand 10, of the arrangement of the pivot levers 8 and 9 on both sides of the housing intermediate wall 5 and of the articulation of the rear, longer U-leg on the housing intermediate wall 5, via the link 11, which is mounted laterally on said housing intermediate wall at 12, the carrier hand, during the return stroke of the actuating arrangement counter to the direction of the arrow F, can be raised to a great extent in the rear region and does not strike against the housing intermediate wall 5, but rather can be guided past laterally on both sides of the housing wall by way of its U-legs.

On the push-in-finger shaft 13, a guide contact lever 16 is fastened in a laterally offset manner in the region located between the U-legs of the carrier hand 10. As seen along the axis of the push-in-finger shaft, the guide contact lever 16 is located diametrically opposite the push-in fingers 14 and 15. The free end of the guide contact lever 16 bears a guide contact roller (guide contact element) 17 as guide contact element. The guide contact roller 17 is located between vertical planes which are parallel to the housing side parts 2 and are determined for example by the side surfaces of the housing intermediate wall 5. The purpose of this design is that the guide contact roller 17 can make contact with the bottom border 18 of the housing intermediate wall 5 as fixed guide part during the operating stroke of the actuating arrangement. At that end of the bottom border of the housing intermediate wall 5 which is located counter to the conveying direction corresponding to the arrow F, said bottom border has a ramp 19 and a plateau 20, as is shown clearly in detail in FIGS. 1 and 3.

In the space between the bottom border 18 of the housing intermediate wall 5 and the surface of the base plate 4, furthermore, a changeover guide part 21 is provided as double-action diverter. This changeover guide part contains a strip-like guide path 22, which extends approximately in the conveying direction corresponding to the arrow F and occupies a space which is bounded by the vertical planes corresponding to the two side surfaces of the housing intermediate wall. The longitudinal progression of the guide path 22 is described in detail hereinbelow. Attached laterally to the guide path 22 is a carrier lever 23, which is guided upward parallel to the housing intermediate wall 5 and is mounted pivotably on the pivot bearing 24 on the housing intermediate wall 5. A tension spring (spring prestressing) 25 acts at the top end of the carrier lever 23 and prestresses the changeover guide part, formed from the parts 22 and 23, into the position which is shown in FIG. 1.

It can be seen that, on account of the U-shaped design of the carrier hand 10, it is possible for the latter, by way of its end which is located counter to the conveying direction corresponding to the arrow F, not just to be guided upward past the housing intermediate wall 5, but also past the changeover guide part 21.

The guide path 22 of the changeover guide part 21 contains a ramp section 26, which is at the front in relation to the conveying direction corresponding to the arrow F, and rectilinear-guidance sections (main guidance section) 27 and 28, which adjoin the ramp section to the rear and, in a vertical plane, enclose between them an obtuse angle which opens toward the base plate 4. The transition between the two rectilinear-guidance sections 27 and 28 is located approximately where the carrier lever 24 is attached to the guide path 22.

During the return stroke of the actuating arrangement 6 counter to the conveying direction illustrated by the arrow F, the guide contact roller 17 runs mainly on that surface of the guide path 22 which is directed toward the base plate 4. During the operating stroke of the actuating arrangement 6, the guide contact roller 17 runs exclusively on the housing-side guide part in the form of the bottom border 18 of the housing intermediate wall 5. The operating stroke of the actuating arrangement 6 begins when the carrier hand 10 of the actuating arrangement is drawn back, by way of the pivot levers 8 and 9 and the link 11, to such an extent that the guide contact roller 17 assumes a position on the plateau 20 of the bottom border 18 of the housing intermediate wall 5. If the pivot levers 8 and 9 are then pivoted forward, by a drive mechanism which will be described briefly hereinbelow, then the guide contact roller 17 leaves the plateau 20 and runs along the ramp 19, the contact roller 17 being held in abutment against the housing-side guide part by the helical spring 16 via the push-in-finger shaft 13 and the guide contact lever 16. As the guide contact roller 17 runs along the ramp 19, the push-in fingers 14 and 15 are pivoted downward and the outer ends of the push-in fingers lower onto the base plate 4. The guide contact roller 17 then follows the horizontally running section of the bottom border of the housing intermediate wall 5. In this way, the guide contact roller 17 finally comes into contact with the guide-path section (ramp section) 26 of the changeover guide part 21, as a result of which the changeover guide part 21 is pivoted, counter to the prestressing force of the spring 25 in the clockwise direction in relation to the illustration of FIG. 1, with the result that the guide contact roller 17 can be moved past the guide-path section 26 and reaches the outer end of the horizontal section of the housing-side guide part. In this position, the changeover guide part 21 can swing back again into the position which is shown in FIG. 1, the end of the operating stroke being reached in this way.

If the carrier hand 10 then swings back counter to the conveying direction according to arrow F, in the return stroke, by way of the pivot levers 8 and 9 and the link 11, then the guide contact roller 17 leaves the plateau on the bottom border of the housing intermediate wall 5 and moves over the underside of the ramp section 26 of the changeover guide part 21, the guide contact roller 17 being held in abutment against the guide path of the changeover guide part 21 by the prestressing force exerted by the helical spring 16. As the guide contact roller 17 runs along the ramp section 26 of the guide path (running path) 22, the guide contact lever 16 and correspondingly also the push-in fingers 14 and 15 are pivoted in the anticlockwise direction in relation to the illustration of FIG. 1, the outer ends of the push-in fingers 14 and 15 being raised from the surface of the base plate 4 and, when the guide contact roller 17 has reached the rectilinear-guidance section 27 of the guide path 21, being guided over the base plate 4, at an approximately constant distance therefrom, as the return stroke of the actuating arrangement continues.

Once the guide contact roller 17, as the return stroke of the actuating arrangement 6 continues, reaches the transition between the main guidance sections 27 and 28, it being possible for this transition to be referred to as a bend, then, as the guide contact roller 17 runs against the beginning of the rectilinear-guidance section 28 under the contact-pressure force exerted by the helical prestressing spring, a force component is produced at the point of contact between the guide contact roller 17 and the rectilinear-guidance section 28 of the guide path 22 approximately in the horizontal direction counter to the conveying direction according to arrow F. This horizontal force component results in the changeover guide part 21 being subjected to a torque in the clockwise direction in relation to the point of articulation (pivot bearing) 24 of the carrier lever 23. As soon as this torque, during the continuation of the return stroke of the actuating arrangement, overcomes the prestressing torque exerted on the carrier lever 23 by the tension spring 25, the changeover guide part 21 swings from the position which is shown in FIG. 1 into the position which is shown in FIG. 3, in which the main guidance section 28 of the guide path 22 then runs approximately horizontally and adjoins the plateau 20 of the bottom border of the housing intermediate wall 5 in a flush manner. Over the main guidance section 28, the guide contact roller 17 then finally reaches the plateau 20, essentially without changing its vertical position, in order from there, in the operating stroke of the actuating arrangement 6, to take its route over the bottom border of the housing intermediate wall 5, that is to say over the housing-side guide part.

It can be seen that there is no need for any separate actuating mechanism for the purpose of actuating the changeover guide part 21. Rather, this guide part is actuated by the guide contact element, which is coupled to the push-in fingers 14 and 15, on account of the movement of the actuating arrangement in the operating stroke and in the return stroke. That space between the housing side parts 2 which is located beneath the carrier hand 10 and above the base plate 4 is kept entirely clear of actuating elements for moving the guide contact element, that is to say, in the present exemplary embodiment, the guide contact roller 17. It is only the push-in fingers 14 and 15, in their operating stroke, which pass through said space. The entire interspace between the housing side parts 2 is thus available for conveying correspondingly large-format enclosures.

It is also of note that the design specified here is largely symmetrical in relation to the housing intermediate wall 5. In specific terms, the push-in fingers 14 and 15 are located opposite one another in relation to the vertical plane which is determined by the housing intermediate wall 5. The same applies for the U-legs of the carrier hand 10 and for the pivot levers 8 and 9 for the purpose of articulating the carrier hand 10 on the spindle (pivot axis) 7, which is supported mainly by the housing intermediate wall 5. The guide parts for the purpose of actuating the push-in fingers 14 and 15 via the guide contact element or the guide contact roller 17, the guide contact lever 16 and the push-in-finger shaft 13 are located essentially within the vertical space determined by the side surfaces of the housing intermediate wall 5. This symmetrical construction results in balancing of the stressing in the bearings and in increased smoothness of running. The wear is reduced and reliability during operation is increased.

The drive mechanism for the purpose of carrying out the operating stroke and the return stroke of the actuating arrangement 6 in pivot movements back and forth will now be described briefly.

It can be seen from FIG. 3 that, on its side remote from the mounting on the housing side part 2, the spindle 7 projects out beyond the mounting in the housing intermediate wall 5. The pivot lever 8 is fastened on the spindle 7 in this projecting section. Moreover, an auxiliary lever 30 is mounted on said section of the spindle 7 such that it can be rotated with respect to the spindle 7. Side members 31 and 32 of the auxiliary lever 30, which contain the rotary bearings, are each located on one side of the fastening location of the pivot lever 8 on the spindle 7, as can be seen from FIGS. 2 and 3. Moreover, running between the side members 31 and 32 of the auxiliary lever 30 is a stop and bearing bolt 33 which is connected fixedly to the auxiliary lever 30 and, on that side of the latter which is remote from the housing intermediate wall 5, projects beyond the auxiliary lever 30 and serves as a spring stop for a helical prestressing spring 34 which wraps around the spindle 7. The other end of the helical prestressing spring 34 is supported on a stop pin of a spring bearing 35 which is clamped firmly on the outer end of the spindle 7 such that its rotary position can be adjusted. On account of the arrangement shown, the helical prestressing spring 34 presses the auxiliary lever 30 in the direction of the pivot lever 8, with the result that the stop and bearing bolt 33 is held in abutment against a narrow side of the pivot lever 8.

The person skilled in the art can see from the illustration in FIGS. 2 and 3 that the interspace between the side members 31 and 32 of the auxiliary lever 30 is larger than the thickness of the pivot lever 8 in the direction of the pivot spindle 7. This keeps clear a section of the stop and bearing bolt 33 as a bearing spindle for a connecting rod 36 which, on its side remote from the auxiliary lever 30, is coupled to a crank 38, which is driven by a crankshaft 37. The crankshaft 37 is supported with respect to the housing intermediate wall 5 by means of a bearing and on the housing part 2 by means of a bearing 39. Drive elements for driving the crankshaft 37 are located in the housing space which is formed by the border flanges of the housing side part 2 and is outside the space between the housing side parts. Since they are not necessary for understanding the invention, and for the sake of simplification of the illustration, details in this respect have been left out. It should also be mentioned here that, since it is located behind the spindle 7, the crankshaft 37 cannot be seen in the illustration of FIG. 3.

The design of the auxiliary lever 30, on which the connecting rod 36 of the drive mechanism acts and which is pressed, by way of its stop and bearing bolt 33, against the narrow side of the pivot lever 8 by the helical prestressing spring 34, forms an overload-prevention means. If, in the operating stroke, the push-in fingers 14 and 15 come up against a considerable resistance, then the actuating mechanism 6 may come to a standstill by the resistance of the obstruction, while the auxiliary lever is pivoted further, counter to the prestressing force of the helical prestressing spring 34, by the connecting rod 36, the stop and bearing bolt 33 being raised from the narrow side of the pivot lever 8. This avoids the actuating arrangement being destroyed or the push-in fingers, or the articles which are to be conveyed, being damaged.

It can be seen from FIG. 1 that the arrangement specified here can interact with circulating conveying chains 40, which are laid over chain wheels 41 and are provided with conveying fingers 42, with the result that pairs of conveying fingers 42, which are fastened on one conveying chain and the other conveying chain one beside the other transversely with respect to the conveying direction, in each case form conveying compartments in the region of the top strand of the circulating conveying chains 40. For this purpose, the conveying fingers 42 pass through slots of a conveying path or through cutouts of the base plate 4 and continue their route, following the conveying chains 40, up to the chain wheels 41. Then the conveying fingers 42 are lowered beneath the level of the base plate 4, in corresponding cutouts of the latter and, still following the conveying chains 40, are guided back to a chain wheel at the beginning of the conveying path. The conveying chains 40 may be driven intermittently or continuously. With the conveying chains 40 being driven continuously and thus the conveying fingers 42 being moved essentially continuously, the conveying speed is coordinated with the movement sequence of the actuating arrangement 6 such that the outer ends of the push-in fingers 14 and 15, said ends being located on the level of the top side of the base plate 4 in the operating stroke, pass a conveying-finger pair 42, before the latter lowers beneath the level of the base plate 4 as it reaches the chain wheel 41, and raise from the conveying fingers 42 a sheet-like article which has previously been advanced over the base plate 4 by the relevant conveying-finger pair 42 and advance said article further over the base plate 4 and, if the handling apparatus specified here is an envelope-filling station, push said article into an open envelope.

Of course, the horizontal distance between the push-in fingers 14 and 15 transverse with respect to the conveying direction according to arrow F may be selected to differ from the horizontal distance between the conveying fingers of a conveying-finger pair 42, with the result that, in the return stroke of the actuating arrangement 6, the push-in fingers 14 and 15 can easily be moved past conveying fingers 42 without it being necessary for the push-in fingers 14 and 15 to be raised to such an extent that the bottom ends of the push-in fingers 14 and 15 are drawn back above the level of the top ends of the conveying fingers 42.

Figure 4:
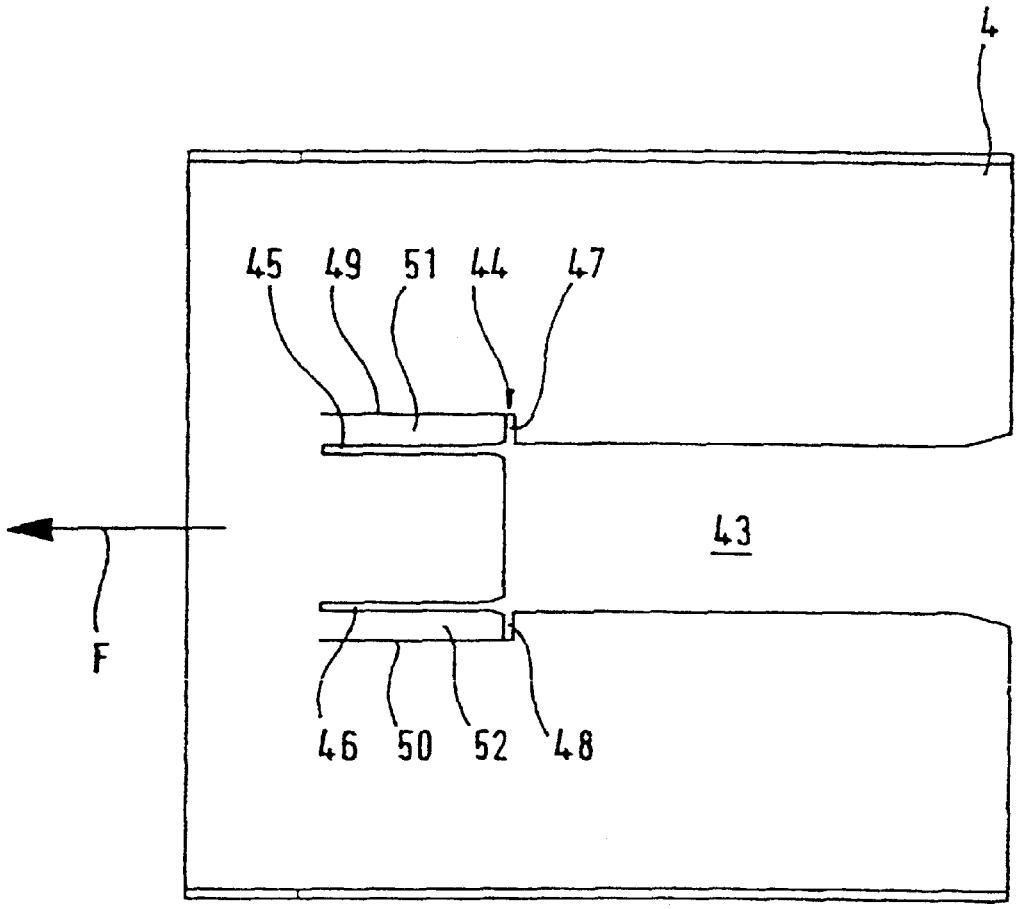
FIG. 4 illustrates a plan view of the base plate for the apparatus according to FIGS. 1 and 3, its front end being illustrated in somewhat simplified form.

According to a preferred embodiment, the configuration of the base plate 4 of the handling apparatus specified here may, in plan view, be of the form shown in FIG. 4. Provided in an inlet region of the base plate 4 is a wide rectangular cutout 43, of which the width is selected to be somewhat greater than the horizontal distance between the conveying fingers 42 of a conveying-finger pair. This cutout extends up to a region which is indicated at 44 in FIG. 4 and in which the conveying fingers 42, with the circulation of the associated conveying chains 40 beneath the surface of the base plate 4, begin to be pivoted down. The cutout 43 is adjoined by slots (parts) 45 and 46 which run parallel to the conveying direction according to arrow F and of which the respective width is somewhat greater than the thickness of the conveying fingers 42 in the direction transverse with respect to the conveying direction.

It can be seen from FIG. 4 that in the region 44 in the base plate 4, at the transition between the cutout 43 and the narrow slots 45 and 46, short cutouts 47 and 48 are also provided, and that, parallel to the narrow slots 45 and 46, fine severing cuts 49 and 50 are routed, from the cutouts 47 and 48, parallel to the slots 45 and 46. The slots 45 and 46, the cutouts 47 and 48 and the severing cuts 49 and 50 thus form, on the base plate 4, resilient tongues (regions) 51 and 52 which run parallel to the conveying direction according to arrow F. As can be seen from the illustration of FIG. 3, these resilient tongues, at the end adjacent to the cutouts 47 and 48, are each bent down slightly with respect to the horizontal plane corresponding to the surface of the base plate 4, with the result that the resilient tongues 51 and 52 form slightly resilient ramp surfaces.

The resilient tongues 51 and 52, then, occupy, on the base plate 4, precisely those surface areas on which is located, during the movement of the guide contact roller 17 over the ramp 19 of the framework-side guide part, the route of the bottom ends of the push-in fingers 14 and 15 in vertical projection onto the base plate 4.

According to a preferred embodiment of the base plate 4 in interaction with the guide system in relation to the guide contact roller 17, the housing-side guide part on the bottom border of the housing intermediate wall 5 is configured, and the resilient tongues 51 and 52 are bent down to such an extent, that when, in the operating stroke, the guide contact roller makes the transition from the ramp 19 to the horizontal section and the bottom ends of the push-in fingers 14 and 15 reach their lowest position, the push-in fingers, although lowered beneath the level of the top side of the base plate 4 in the region of the resilient tongues 51 and 52, still do not quite come into contact with said tongues. During the continuation of the operating stroke, the bottom ends of the push-in fingers 14 and 15 then run smoothly onto the resilient tongues 51 and 52, which act as ramps and, in addition, are resilient. As the operating stroke continues, finally, the guide contact element or the guide contact roller 17 is raised slightly, counter to the prestressing force effected by the helical spring, from the horizontal guide-path section of the housing-side guide part.

It can be seen that the design of the base plate 4 in the region of the points of contact and of the path of the bottom ends of the push-in fingers as cut-out resilient ramps results, in operation, in a smooth and low-noise operating cycle of the push-in fingers, even at high operating speeds. As a result, the effect achieved as far as smoothness of running is concerned, even at a high operating speed, is enhanced further on account of the guide control means, for the push-in fingers, specified here.

What is claimed is:

1. An apparatus for handling sheet articles, in particular enclosures in an envelope-filling station of mail-processing machines, having a base plate (4), over which the sheet articles are conveyed in a state in which they rest on the base plate, having an actuating arrangement (6), which has a carrier hand (10) which, by means of a drive mechanism (30, 36, 38, 37) of the actuating arrangement, can be moved back and forth over the base plate (4), parallel to the conveying direction (F), such that at least part of the carrier hand (10) is guided rectilinearly over the base plate (4), and having push-in fingers (14, 15), which are articulated on the carrier hand and, in a guide-controlled manner, are lowered onto the base plate in the operating stroke and are raised from the base plate (4) in the return stroke, the push-in fingers (14, 15) being fastened on a push-in-finger shaft (13) which is coupled to a guide contact element (17), wherein in the operating stroke the guide contact element (17) interacts with a framework-side guide part (18, 19, 20), and in the return stroke it interacts with a changeover guide part (21, 23) which is mounted pivotably (at 24) on the framework and which, in one pivot position, assumed counter to spring prestressing (25), allows the guide contact element (17) at the end of the operating stroke, to end its route on the framework-side guide part and, at the end of the return stroke to end its route with a smooth transition from the changeover guide part (21, 23) to the framework-side guide part (18, 19, 20) and which, in the other pivot position, into which it is spring-prestressed, directs the guide contact element (17), at the beginning of the return stroke, from the framework-side guide part onto the changeover guide part (21, 23) and, at the beginning of the operating stroke, releases the route for the guide contact element (17) on the framework-side guide part (18, 19, 20), it being the case that the changeover guide part (21, 23) is pivoted, counter to the spring prestressing (25), by the guide contact element (17), and the pivot axis is oriented in the horizontal direction, perpendicularly to the conveying direction (F), and is located above the framework-side guide part (18, 19, 20).

2. The apparatus as claimed in claim 1, wherein the framework-side guide part (18, 29, 20) is located above a considerable part of the route of the carrier hand (10), and in that the changeover guide part (21, 23) is arranged beneath the framework-side guide part (18, 19, 20), closer to the base plate (4), and is articulated on the framework via a pivot bearing (24), which is located above the path of the guide contact element (17) on the framework-side guide part (18, 19, 20) and approximately halfway along the length of the path of the changeover guide part.

3. The apparatus as claimed in claim 2, wherein the path (22) of the changeover guide part (21, 23) has a ramp section (26), which is assigned to the beginning of the return stroke of the carrier hand (10) and of the guide contact element (17) and is intended for actuating the guide contact element (17) with the effect of raising the push-in fingers (14, 15) from the base plate (4), an adjoining, first main guidance section (27), for the purpose of returning the raised push-in fingers over the base plate, and a further main guidance section (28), which forms such an angle with respect to the first main guidance section (27) that when the guide contact element (17) arriving from the first main guidance section (27) runs against the further main guidance section (28), the contact pressure of the guide contact element (17) against the further main guidance section (28) has a force component which, in relation to the pivot bearing of the changeover guide part (21, 23), produces a changeover moment which positions the end of the further main guidance section of the changeover guide part (21, 23) against the framework-side guide part (18, 19, 20).

4. The apparatus as claimed in claim 1, wherein the framework-side guide part (18, 19, 20) is formed on the bottom border, which is at a distance opposite the base plate (4), of a vertical housing intermediate wall (5), which is parallel to the conveying direction (F), is located between vertical housing side walls (2), which are parallel to the conveying direction (F) and belong to a housing (1) of the apparatus, and bears bearings for spindles and shafts of the actuating arrangement (6), as well as a pivot bearing (24) for the changeover guide part (21, 23), such that beneath the framework-side guide part (18, 19, 20), the changeover guide part (21, 23) and the carrier hand (10), with the push-in fingers (14 15) raised, above the base plate (4) a through-space, which extends essentially over the distance between the housing side walls (2), is kept free for the sheet articles.

5. The apparatus as claimed in claim 4, wherein the lengths of the pivot levers (8, 9) and of the links (11) and the distances between the points of articulation thereof on the framework of the apparatus and on the carrier hand (10) are of such magnitudes that the push-in-finger shaft (13) is moved approximately parallel to itself and to the base plate in the operating stroke and in the return stroke, and that, at the end of the return stroke, the rear ends of the side legs of the U-shaped carrier hand (10) can be moved past the bottom border of the vertical housing intermediate wall (5), on both sides of the latter.

6. The apparatus as claimed in claim 1, wherein the guide contact element (17) is arranged on a contact-element lever (16) which is fastened on the push-in-finger shaft (13), extends rearward from the push-in-finger shaft, approximately parallel to the direction of the push-in fingers (14, 15), and passes through a rearwardly open cutout of the approximately U-shaped carrier hand (10), it being the case that the push-in-finger shaft (13) is mounted between the side legs of the U-shaped carrier hand, in the vicinity of the closed side of the latter, and pivot levers (8, 9) and links (11) of the actuating arrangement (6) are articulated on the side legs of the U-shaped carrier hand (10), at a certain distance from the closed side of the latter.

7. The apparatus as claimed in claim 1, wherein at the points where the free ends of the push-in fingers (14, 15) lower onto the base plate (4) at the beginning of the operating stroke, the base plate (4) is provided with depressions (51, 52), which are each assigned to the push-in fingers (14, 15) and from which ramp paths, running in the direction of the ends of the push-in fingers (14, 15), extend up to the level of the base plate surface, and in that the framework-side guide part (18, 19, 20) is formed, or stops assigned to the push-in fingers are designed, such that the ends of the push-in fingers do not reach the base of the depressions as they are lowered onto the base plate (4), and it is only during the operating stroke, in the region of the ramp paths, that they come into contact with the base plate.

8. The apparatus as claimed in claim 7, wherein the depressions and the associated ramp paths are formed by tongue-shaped regions (51, 52) of the base plate (4) being bent in the downward direction, said regions being bounded by U-shaped severing cuts (45, 47, 49; 46, 48, 50).

9. The apparatus as claimed in claim 8, wherein the severing cuts have widened parts (45, 46) through which conveying fingers (42) of conveying chains (40) engage and can be drawn back beneath the base plate (4), said conveying chains conveying the sheet articles, in particular the enclosures, onto the base plate so as to be handled by the push-in fingers (14, 15).

* * * * *